US010933550B2

(12) United States Patent
Banowetz et al.

(10) Patent No.: US 10,933,550 B2
(45) Date of Patent: Mar. 2, 2021

(54) SIZE-REDUCTION MACHINE AND SIZE-REDUCTION UNIT THEREFOR

(71) Applicant: Urschel Laboratories, Inc., Chesterton, IN (US)

(72) Inventors: Daniel Lawrence Banowetz, Dyer, IN (US); Daniel Wade King, Valparaiso, IN (US)

(73) Assignee: Urschel Laboratories, Inc., Chesterton, IN (US)

( * ) Notice: Subject to any disclaimer, the term of this patent is extended or adjusted under 35 U.S.C. 154(b) by 0 days.

(21) Appl. No.: 16/008,409

(22) Filed: Jun. 14, 2018

(65) Prior Publication Data

US 2018/0361606 A1 Dec. 20, 2018

Related U.S. Application Data

(60) Provisional application No. 62/519,227, filed on Jun. 14, 2017.

(51) Int. Cl.
*B26D 3/22* (2006.01)
*B26D 7/32* (2006.01)
(Continued)

(52) U.S. Cl.
CPC ..... *B26D 3/22* (2013.01); *B26D 1/0006* (2013.01); *B26D 1/22* (2013.01); *B26D 1/38* (2013.01);
(Continued)

(58) Field of Classification Search
CPC ..... B26D 3/18; B26D 3/22; B26D 2210/02; B26D 2001/006; B26D 2001/0066; B26D 1/22; B26D 1/38; B26D 7/32; B26D 7/065
See application file for complete search history.

(56) References Cited

U.S. PATENT DOCUMENTS 3,777,600 A * 12/1973 Long ..... B26D 1/28 83/39
3,837,249 A * 9/1974 Long ..... B26D 3/22 83/408
(Continued)

FOREIGN PATENT DOCUMENTS

WO 9915320 4/1999

OTHER PUBLICATIONS

International Search Report and Written Opinion dated Oct. 15, 2018 for PCT/US18/37499.

*Primary Examiner* — Jennifer B Swinney
(74) *Attorney, Agent, or Firm* — Hartman Global IP Law; Gary M. Hartman; Domencia N. S. Hartman

(57) ABSTRACT

Size-reduction units, size-reduction machines, and methods capable of producing size-reduced products from a variety of solid and semisolid materials. A size-reduction unit includes a circular cutter adapted and arranged to cut a product into strips, a rotating cross-cutter adapted and arranged to receive the strips from the circular cutter, and a stripper plate. The cross-cutter has knives with cutting edges that are adapted and arranged to cut the strips into a size-reduced product, and the stripper plate defines a shear edge in proximity to the cutting edge of each knife of the cross-cutter as its cutting edge encounter the shear edge during rotation of the cross-cutter. The cross-cutter has a helical fluted shape comprising flutes between adjacent pairs of the knives.

20 Claims, 15 Drawing Sheets

(51) Int. Cl.

| | |
|---|---|
| ***B26D 7/06*** | (2006.01) |
| ***B26D 1/22*** | (2006.01) |
| ***B26D 1/38*** | (2006.01) |
| ***B26D 1/00*** | (2006.01) |

(52) U.S. Cl.
CPC ..... *B26D 7/0625* (2013.01); *B26D 7/32* (2013.01); *B26D 2001/006* (2013.01); *B26D 2001/0066* (2013.01); *B26D 2210/02* (2013.01)

(56) References Cited

U.S. PATENT DOCUMENTS

| | | | | |
|---|---|---|---|---|
| 4,613,087 | A * | 9/1986 | Snyder | B02C 18/142 241/111 |
| 4,669,344 | A * | 6/1987 | Herrig | B26D 5/32 400/621 |
| 5,129,299 | A | 7/1992 | Fischer et al. | |
| 10,328,596 | B2 * | 6/2019 | Klockow | B26D 7/1845 |
| 2005/0120841 | A1 * | 6/2005 | Castronovo | B02C 18/0007 83/13 |
| 2006/0067797 | A1 | 3/2006 | Calamia | |
| 2007/0079592 | A1 | 4/2007 | Pruitt et al. | |
| 2007/0199419 | A1 * | 8/2007 | Rankin, Sr. | B26D 7/2614 83/13 |
| 2007/0277682 | A1 | 12/2007 | Wong | |
| 2010/0209201 | A1 * | 8/2010 | Davis | B23C 5/10 407/60 |
| 2013/0118325 | A1 * | 5/2013 | Thomas | B26D 3/22 83/13 |
| 2015/0245925 | A1 * | 9/2015 | Willyerd | A61F 2/4644 241/28 |

* cited by examiner

SIZE-REDUCTION MACHINE AND SIZE-REDUCTION UNIT THEREFOR

CROSS REFERENCE TO RELATED APPLICATIONS

This application claims the benefit of U.S. Provisional Application No. 62/519,227, filed Jun. 14, 2017, the contents of which are incorporated herein by reference.

BACKGROUND OF THE INVENTION

The present invention generally relates to methods and machines for cutting solid and semisolid materials, including food products.

The Model M6™ dicer is a versatile size-reduction machine manufactured by Urschel Laboratories, Inc., and is particularly well suited for producing size-reduced products by dicing, strip cutting, or shredding a variety of food products, notable but nonlimiting examples of which include leafy vegetables and frozen-tempered, fresh-chilled, or hot cooked beef, pork, or poultry. The Model M6™ is well known as capable of high capacity output and precision cuts. In addition, the Model M6™ has a sanitary design to deter bacterial growth.

Commercial embodiments of the Model M6™ dicer comprise a size-reduction unit, for example, a size-reduction unit 100 schematically represented in FIGS. 1, 2, and 3. Product 122 is delivered to the size-reduction unit 100 with a conveyor unit comprising a feed belt 102 driven by a drive roll 104, and undergoes size reduction in the size-reduction unit 100 before exiting the dicer as a size-reduced product through an outlet or discharge chute 106. The size-reduction unit 100 represented in FIGS. 1, 2, and 3 as comprising a feed roll 108, a circular cutter 110 comprising a row of circular knives 124, a feed drum 112, a stripper plate 114, and a cross-cutter 116 comprising multiple crosscut knives 120. Each of the feed roll 108, drive roll 104, circular cutter 110, feed drum 112, and cross-cutter 116 individually rotates about its respective axis of rotation, which are generally parallel to each other. In operation, products 122 (FIG. 3) of a predetermined thickness range are delivered to the size-reduction unit 100 on the feed belt 102. Each product 122 is pinched between the feed roll 108 and the drive roll 104 at the end of the feed belt 102. The feed roll 108 is preferably spring loaded and adjustable to allow products 122 of varying thicknesses to move through the unit 100 without being crushed. The feed belt 102 forces the product 122 into the circular cutter 110, whose circular (disk-shaped) knives rotate through complementary grooves formed in the feed drum 112. The circular knives 124 of the circular cutter 110 are oriented perpendicular to the rotational axis of the circular cutter 110, such that the circular cutter 110 cuts the product 122 into multiple parallel strips that are then removed from its circular knives 124 by the stripper plate 114 before being delivered to the cross-cutter 116. The stripper plate 114 has a shear edge 118 at which cross-cuts made by the knives 120 of the cross-cutter 116 occur to reduce the strips to produce, for example, cubes, or rectangular-shaped size-reduced "diced" product 130.

As shown in FIG. 3, the shear edge 118 of the stripper plate 114 provides the location at which cross-cuts are made by the knives 120 of the cross-cutter 116, and a second shear edge 126 defined by the stripper plate 114 serves to extract the strips from the circular cutter 110 prior to being diced with the cross-cutter 116. Slots 128 are defined in the stripper plate 114 facing the circular cutter 110 and partially receive the knives 124 of the circular cutter 110. The slots 128 extend to the shear edge 126, such that individual edges of the shear edge 126 between adjacent slots 128 protrude between adjacent knives 124 of the circular cutter 110 to remove strips from therebetween. The width of each slot 128 of the stripper plate 114 is sufficient to accommodate the axial thickness of one knife 124 of the circular cutter 110 received therein and provide a clearance therebetween. The slots 128 also define parallel walls that separate adjacent knives 124 of the circular cutter 110 from each other.

The shear edge 118 of the stripper plate 114 is in close proximity to the knives 120 of the cross-cutter 116 to ensure complete dicing of the strips delivered from the circular cutter 110 to the cross-cutter 116, producing the final cross-cuts that yield the diced product 130. The knives 120 are generally rectilinear in shape and oriented approximately parallel to the rotational axis of the cross-cutter 116, and therefore parallel to the shear edge 118 of the stripper plate 114 and transverse and perpendicular to the circular knives 124 of the circular cutter 110. The parallel relationship of the cutting edges of the knives 120 and the shear edge 118 define what is referred to herein as a zero shear angle. The knives 120 are separate components attached to a rotor 132 of the cross-cutter 116, and between adjacent knives 120 the rotor 132 defines a channel 134 that is parallel to the rotational axis of the cross-cutter 116. The rotational speed of the cross-cutter 116 is preferably independently controllable relative to the circular cutter 110 and feed drum 112 so that the size of the diced product 130 can be selected and controlled.

FIG. 1 schematically represents the trajectory of a diced product 130 as it exits the size-reduction unit 100 and subsequently falls downward through the discharge chute 106 of the machine. As evident from FIG. 3, as a knife 120 of the cross-cutter 116 engages a product 122, the product 122 is impacted by the knife 120 as the entire cutting edge of the knife 120 simultaneously engages the product 122, referred to herein as a chopping cut. Thereafter, as the cross-cutter 116 continues to rotate, the resulting diced product 130 is impacted by the channel 134 preceding the knife 120 that produced the diced product 130. The channel 134 accelerates the product 122 to the velocity at the radial location on the rotor 132 that impacts the product 122, and thereafter the cross-cutter 116 propels the product 130 along the trajectory depicted in FIG. 1.

In addition to the size-reduction unit 100 depicted in FIGS. 1 through 3, commercial embodiments of the Model M6™ dicer can be equipped with size-reduction units that differ in their components and the size-reduced products they produce. For example, the feed roll 108 of FIGS. 1 through 3 may be replaced with a top belt assembly that comprises a feed belt driven by a drive roll, or the unit may be configured for shredding by replacing the circular cutter 110 with a feed spindle and replacing the cross-cutter 116 with a shredder to produce shredded product. As such, the term "dicer" is not limited to machines with the size-reduction unit 100 of FIGS. 1 through 3.

While the Model M6™ is widely used and well suited for many food processing applications, there is an ongoing desire for greater productivity in machines of this type.

BRIEF DESCRIPTION OF THE INVENTION

The present invention provides size-reduction units, size-reduction machines, and methods capable of producing size-reduced products from a variety of solid and semisolid materials.

According to one aspect of the invention, a size-reduction unit includes a circular cutter adapted and arranged to cut a product into strips, a rotating cross-cutter adapted and arranged to receive the strips from the circular cutter, and a stripper plate. The cross-cutter comprises knives having cutting edges that are adapted and arranged to cut the strips into a size-reduced product, and the stripper plate defines a shear edge in proximity to the cutting edge of each knife of the cross-cutter as its cutting edge encounter the shear edge during rotation of the cross-cutter. The cross-cutter has a helical fluted shape comprising flutes between adjacent pairs of the knives.

According to another aspect of the invention, a dicing machine is provided that includes a size-reduction unit of the type described above.

Other aspects of the invention include methods of using size-reduction units and size-reduction machines of the types described above. Such methods include feeding product to the circular cutter to produce the strips and then dicing the strips with the cross-cutter to produce size-reduced product.

A technical effect of the invention is the ability of the cross-cutter to more gradually accelerate size-reduced product over a relatively long period of time, resulting in much lower impact forces and less damage to the size-reduced product.

Other aspects and advantages of this invention will be better appreciated from the following detailed description.

DETAILED DESCRIPTION OF THE INVENTION

Figure 3:
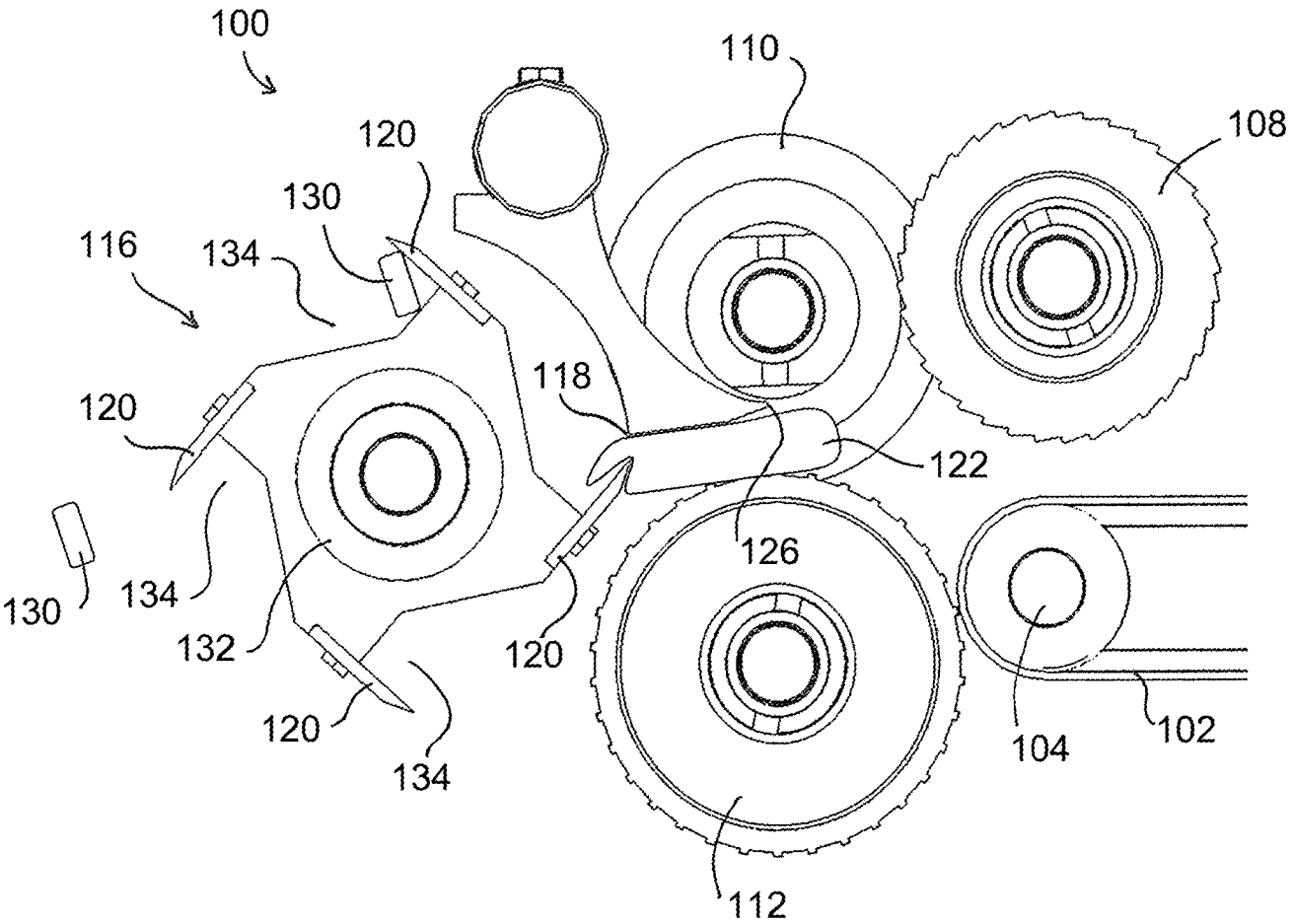
FIG. 3 (Prior Art)
Figure 4:
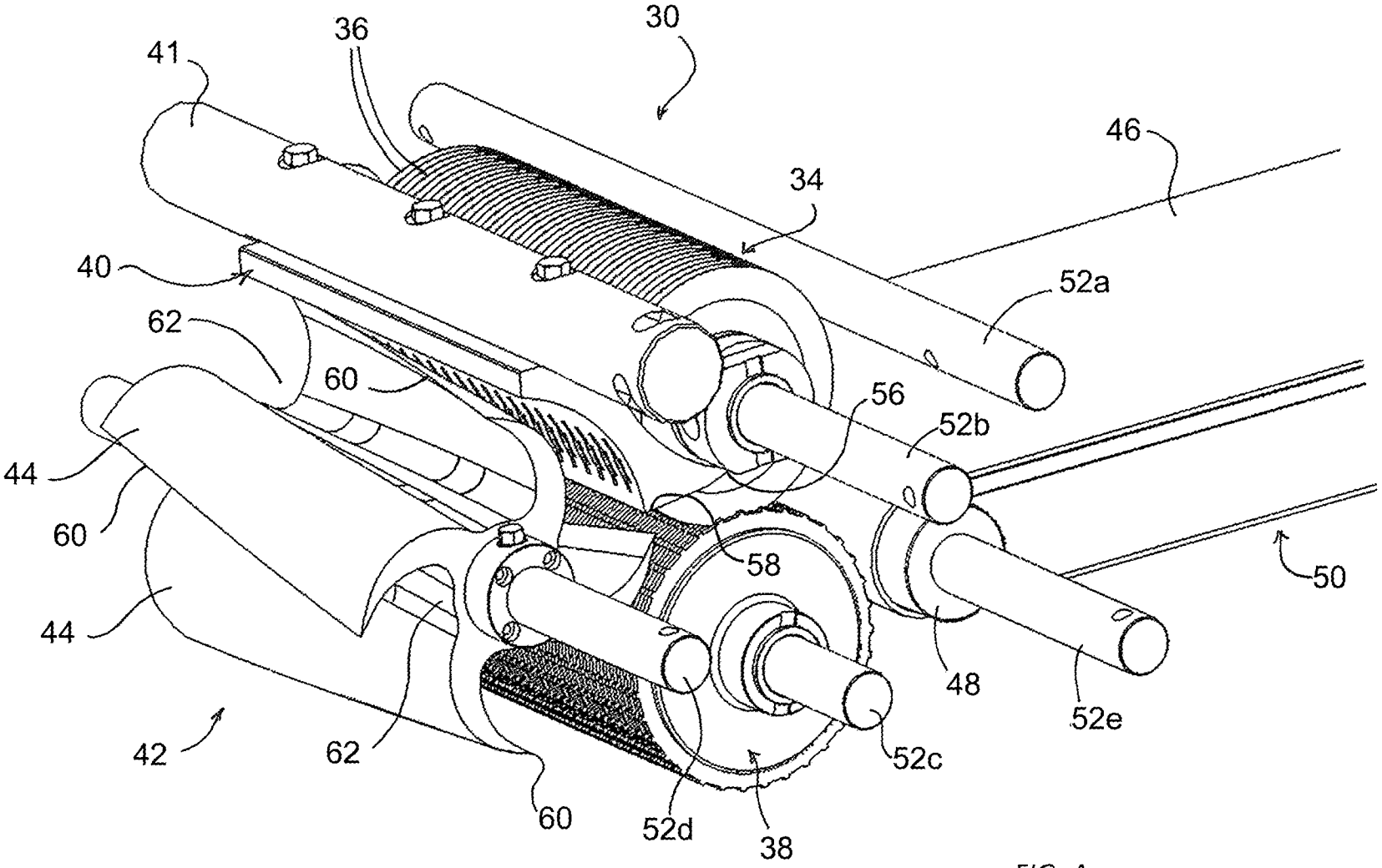
FIGS. 4 through 6 schematically represent different views of a size-reduction unit configured in accordance with a nonlimiting embodiment of the invention and suitable for use in a size-reduction machine of the type represented in FIG. 1.
Figure 5:
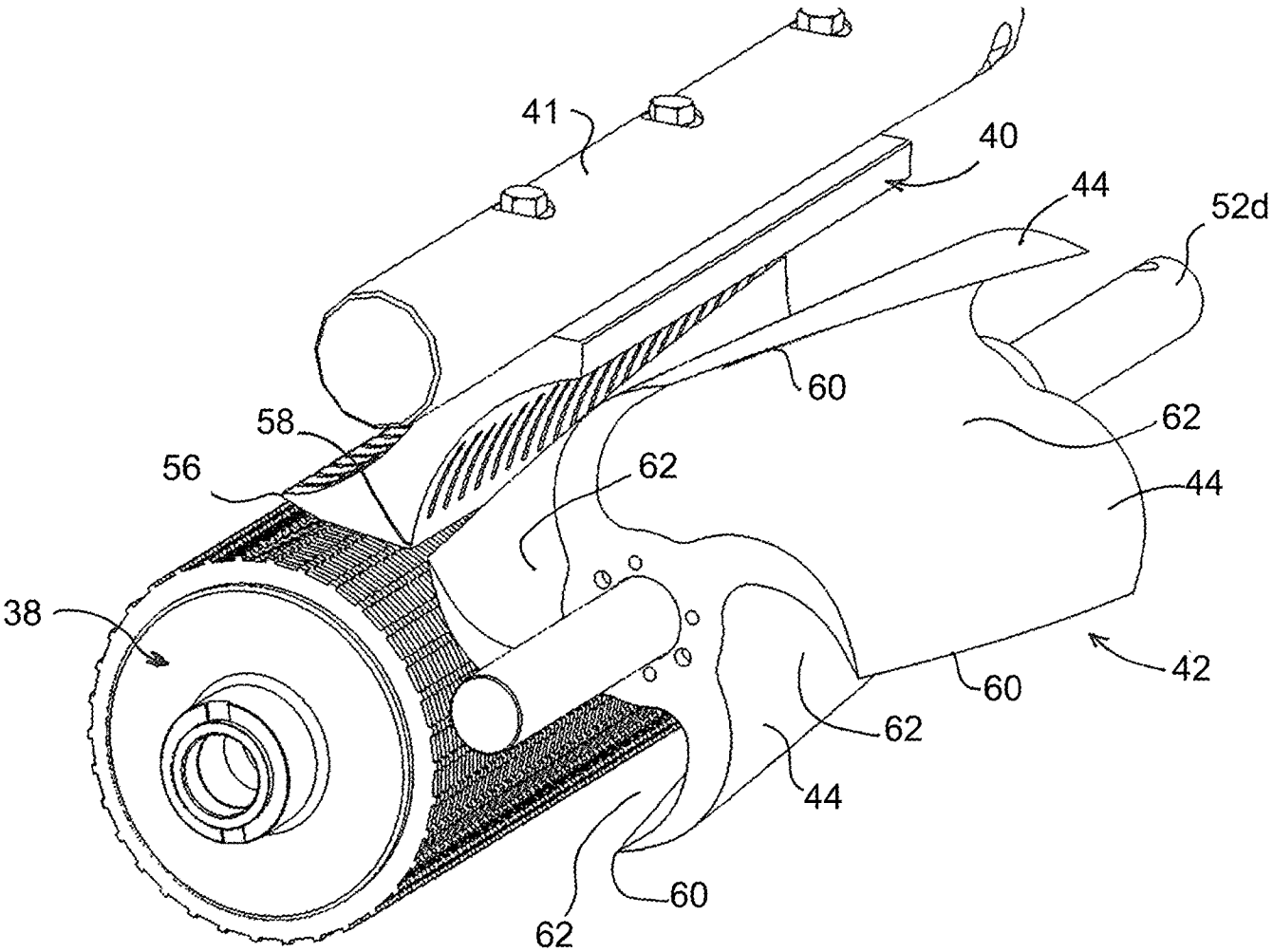
Figure 6:
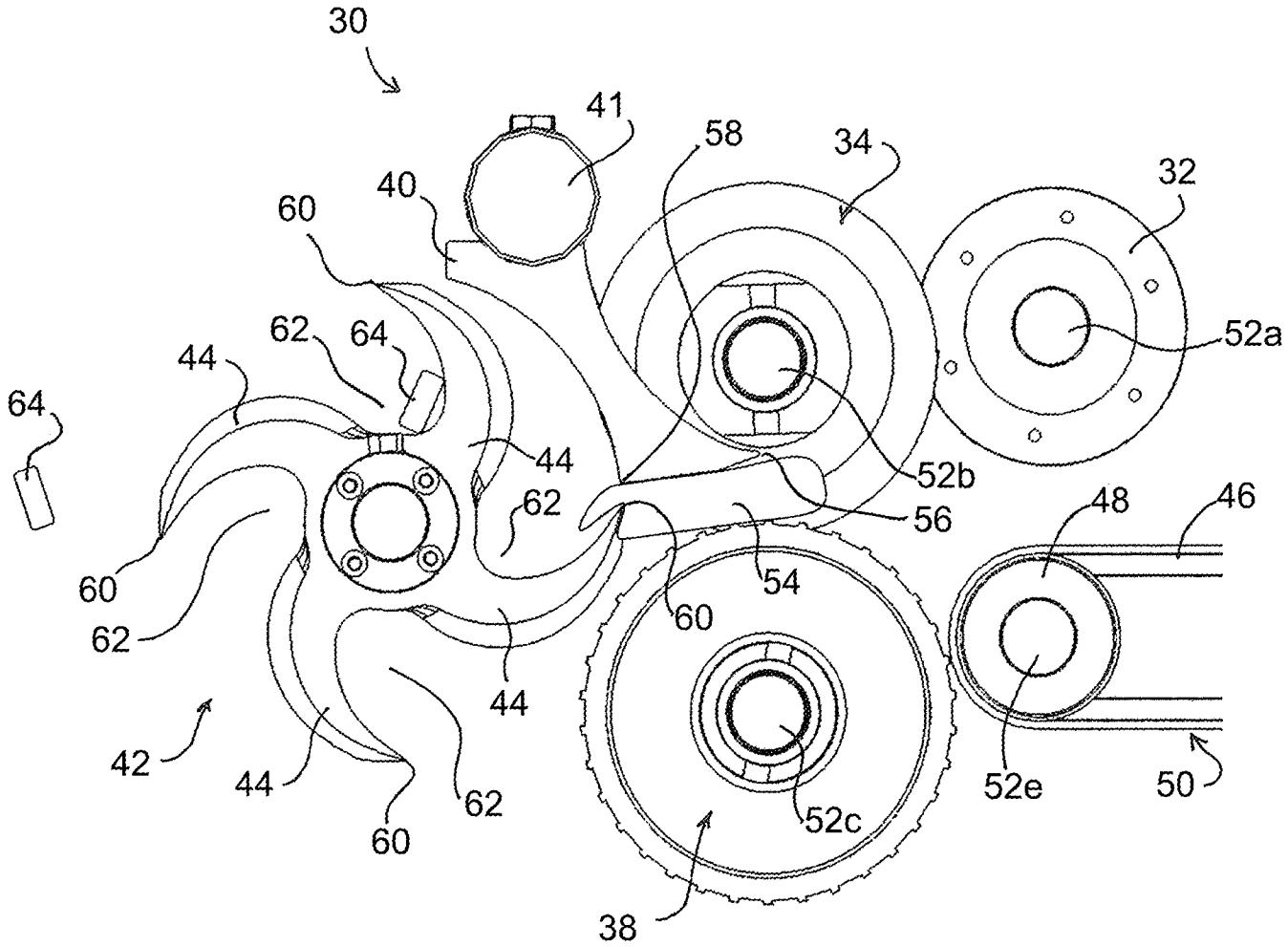
Figure 7:
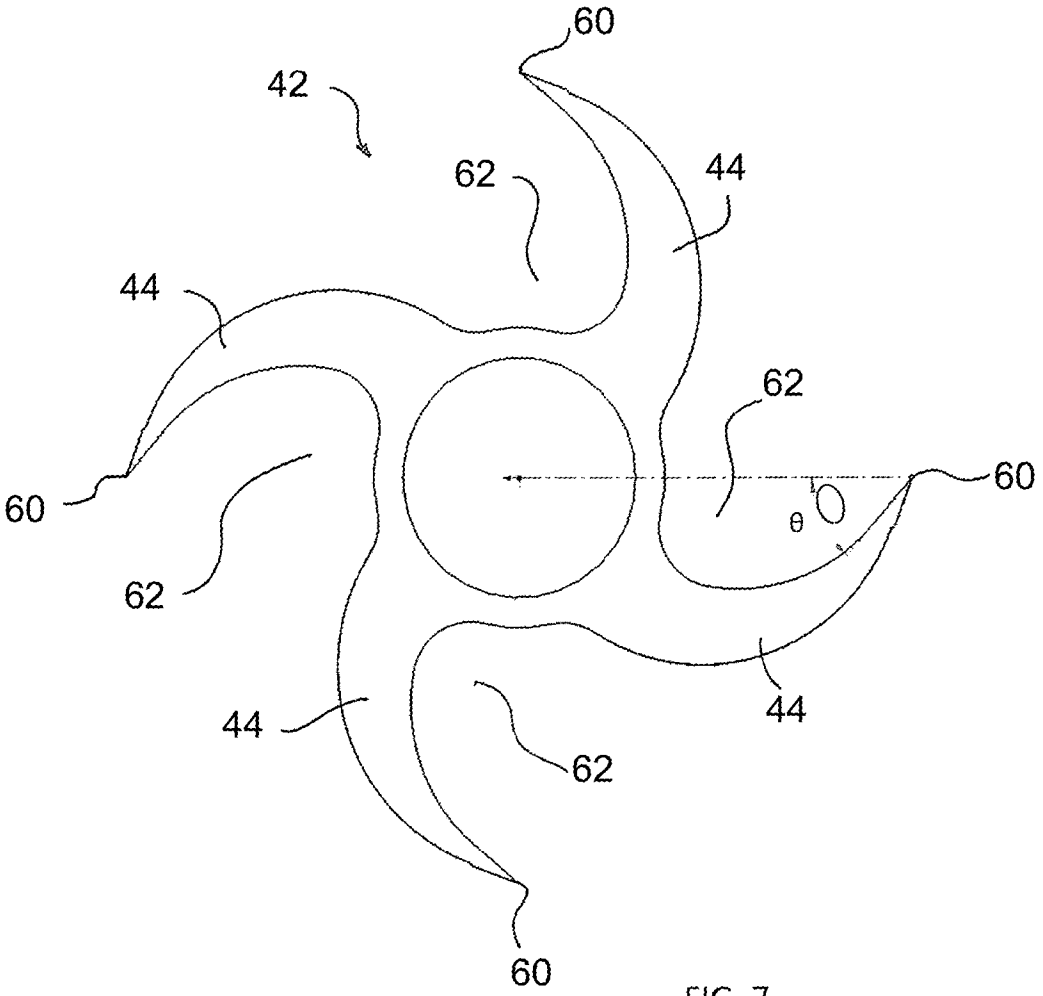
FIGS. 7 through 9 are isolated views of a cross-cutter of the size-reduction unit of FIGS. 4 through 6.

FIGS. 4 through 6 represent isolated views of a size-reduction unit 30 configured to be installed on a size-reduction machine, as a nonlimiting example, the Model M6™ represented in FIG. 1, and FIGS. 7 through 9 and 11 through 14 represent alternative configurations of components that can be utilized in the size-reduction unit 30. The unit 30 is particularly adapted to slice a product and then cut the resulting sliced product (strips) in a direction transverse to the cut that produced the strips (a "cross-cut") to achieve size reduction and produce a size-reduced product, as a nonlimiting example, dicing to produce a diced product. However, those skilled in the art will appreciate that the size-reduction unit 30 and its benefits are not limited to such uses. Furthermore, though the invention will be described hereinafter in reference to a dicer machine of a type shown in FIG. 1, it will be appreciated that the teachings of the invention are more generally applicable to other types of size-reduction machines. In view of similarities between the unit 30 and its components shown in FIGS. 4-9 and 11-15 and the size-reduction unit 100 and its components shown in FIGS. 2-6, the following discussion will focus primarily on certain aspects of the unit 30 and its components, whereas other aspects not discussed in any detail may be, in terms of structure, function, materials, etc., essentially as was described for the size-reduction unit 100 and its components of FIGS. 1 through 3.

Figure 1:
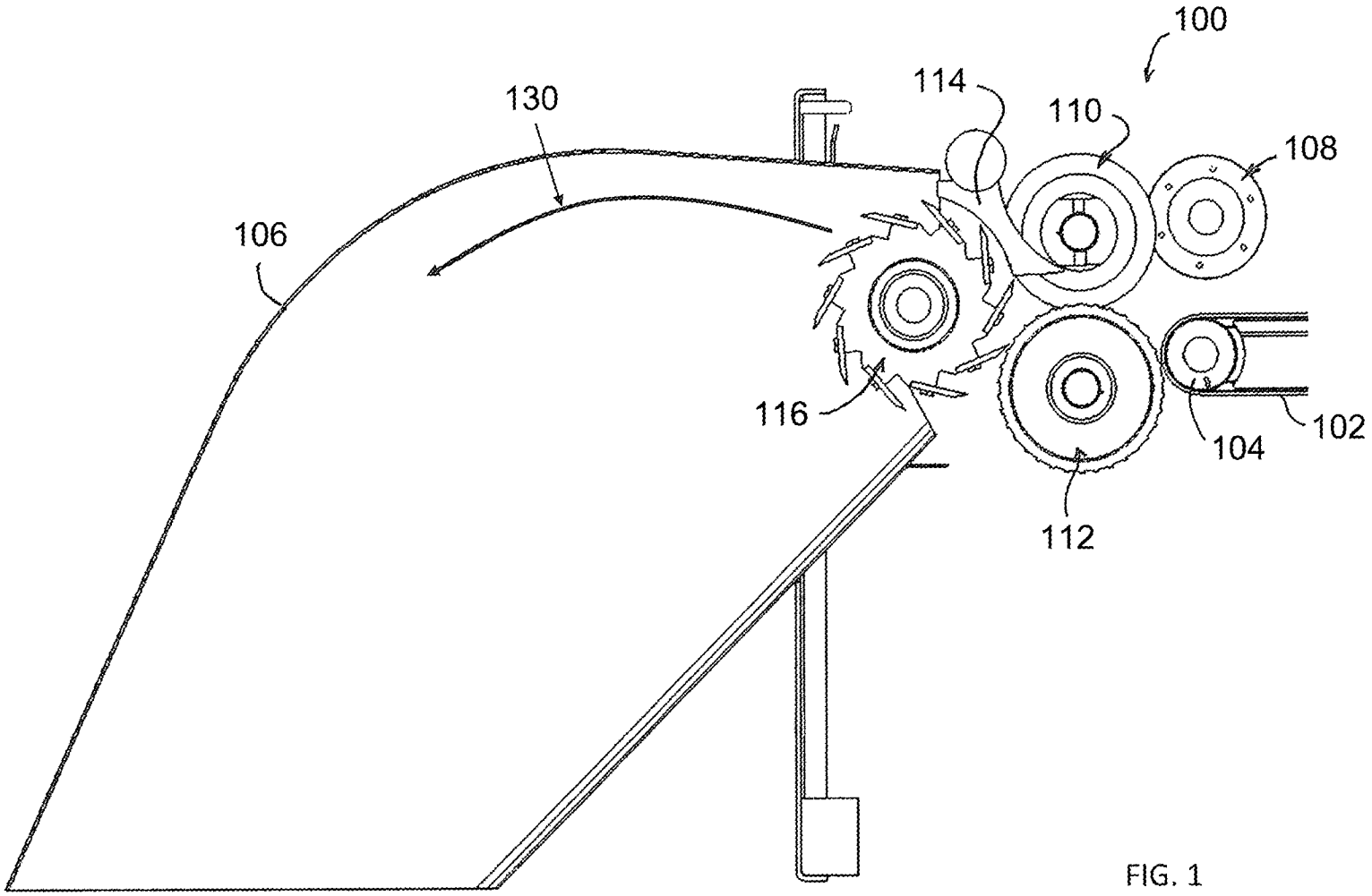
FIG. 1 (Prior Art)
FIG. 1 schematically represents a size-reduction unit located within a discharge chute of a Model M6™ machine manufactured by Urschel Laboratories, Inc.
Figure 2:
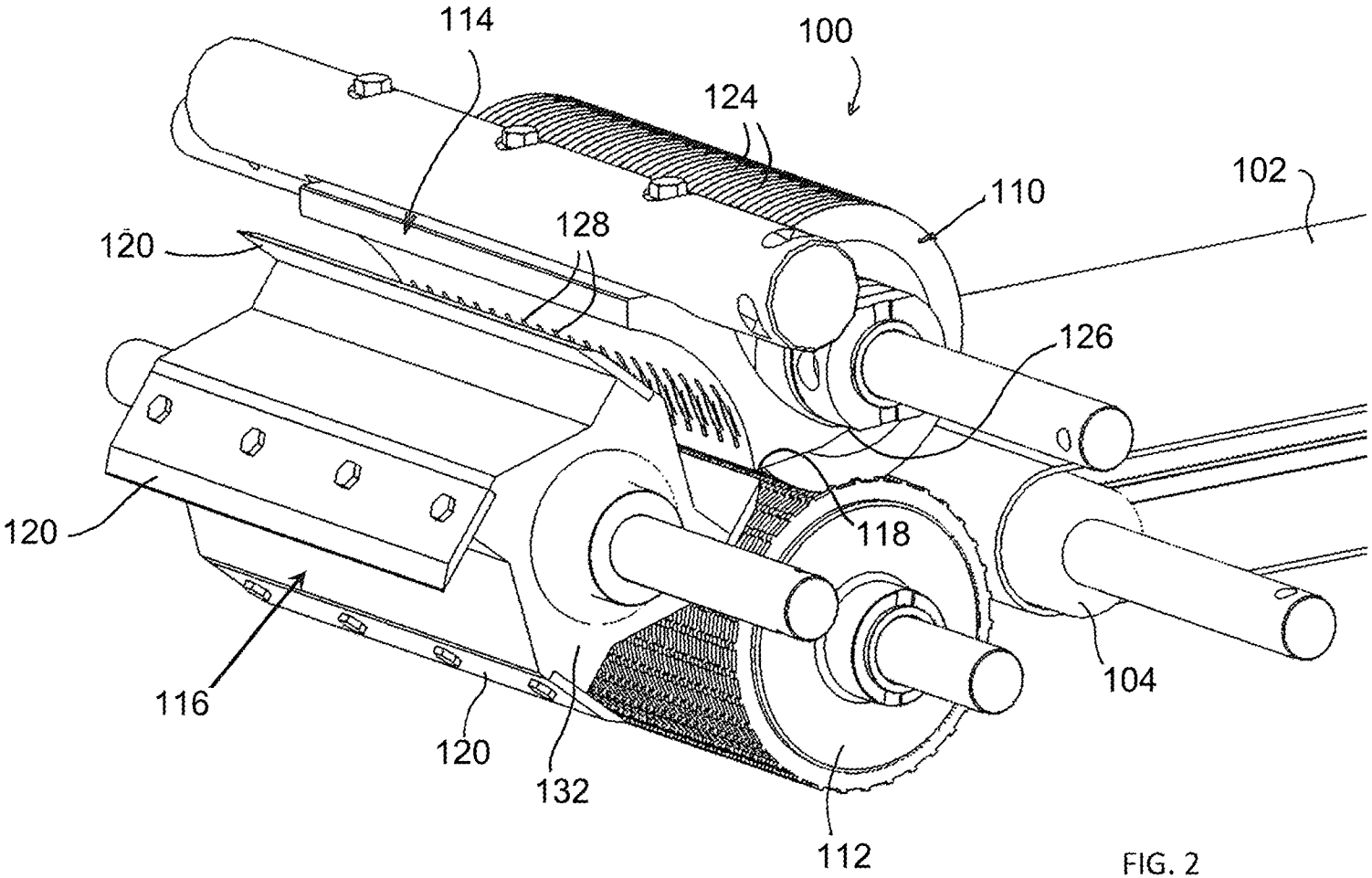
FIG. 2 (Prior Art)
FIGS. 2 and 3 schematically represent additional views of the size-reduction unit of FIG. 1 and show further details of a stripper plate and cross-cutter of the size-reduction unit.

Similar to the size-reduction unit 100 of FIGS. 1 through 3, the size-reduction unit 30 represented in FIGS. 4 through 6 is schematically represented as comprising a feed roll 32 (FIG. 6), a circular cutter 34 comprising a row of circular knives 36, a feed drum 38, a stripper plate 40, and a cross-cutter 42 comprising multiple crosscut knives 44. Product 54 (FIG. 6) is delivered to the unit 30 via a feed belt 46 driven by a drive roll 48, both of which are components of a conveyor unit 50. The feed roll 32, circular cutter 34, feed drum 38, cross-cutter 42, and drive roll 48 are individually mounted on spindles 52*a-e* and rotate about respective axes of rotation that are parallel to each other. The stripper plate 40 is mounted to a support bar 41 to maintain its orientation with the knives 36 of the circular cutter 34.

In operation (FIG. 6), the product 54 is delivered to the size-reduction unit 30 on the feed belt 46. The feed roll 32 is preferably spring-loaded and/or adjustable to enable products 54 of varying thicknesses to move through the unit 30 such that each product 54 is pinched between the feed roll 32 and drive roll 48 at the end of the feed belt 46 without being crushed. Each product 54 is forced into the circular cutter 34, whose circular (disk-shaped) knives 36 rotate through complementary grooves formed in the feed drum 38. The circular knives 36 are oriented approximately perpendicular to the rotational axis of the circular cutter 34, such that the circular cutter 34 cuts the product 54 into multiple parallel strips that are then removed from its circular knives 36 by a shear edge 56 of the stripper plate 40 before being delivered to the cross-cutter 42. The stripper plate 40 has a second shear edge 58 at which cross-cuts made by the knives 44 of the cross-cutter 42 occur to reduce the strips to produce, for example, cubes or rectangular-shaped size-reduced "diced" product of predetermined size.

The shear edge 58 of the stripper plate 40 is in close proximity to the cross-cutter knives 44 to ensure complete dicing of strips delivered from the circular cutter 34 to the cross-cutter 42. As evident from FIGS. 4 through 6, the knives 44 of the cross-cutter 42 are not separate components attached to the cross-cutter 42, but instead are integrally formed features of the cross-cutter 42, though such a configuration is not required. Additionally, the knives 44 are not rectilinear in shape, nor are they oriented parallel to the rotational axis of the cross-cutter 42, or parallel to the shear edge 58, or perpendicular to the circular knives 36 of the circular cutter 34. Instead, the knives 44 have an arcuate shape that results in the cross-cutter 42 having a shape that will be referred to herein as "helical fluted." The term "helical" refers to the geometric shape of each cutting edge 60 of the knives 44, and the term "fluted" refers to deep flutes 62 defined in the cross-cutter 42 between adjacent knives 44. The flutes 62 are not parallel to the rotational axis of the cross-cutter 42, but instead have helical shapes similar to the cutting edges 60 of the knives 44.

Due to the helical shape of the cutting edge 60 of each knife 44, the cutting edges 60 of the cross-cutter 42 have a nonparallel relationship with the shear edge 58 of the stripper plate 40 to define what is referred to herein as a non-zero shear angle. However, the cutting edge 60 is at a constant radius from the axis of rotation of the cross-cutter 42, so that the spacial relationship between the cutting edge 60 and the shear edge 58 of the stripper plate 40 is the same along the entire length of the cutting edge 60 as the edge 60 progressively interacts with the shear edge 58. As such, the entire cutting edge 60 of each knife 44 does not simultaneously engage the product 54, but instead the non-zero shear angle results in a shearing or slicing cut as opposed to the chopping cut associated with the cross-cutter 116 of FIGS. 1 through 3. As a result, the product 54 is sliced progressively across its width rather than all at once, what may be referred to as a scissor action. Progressive slicing requires significantly less force from the cross-cutter 42 than a chopping cut, imparts less force onto the product 54, and produces a more uniform cut.

After being sliced from the original product 54, a diced product 64 (FIG. 6) is impacted and captured by the flute 62 preceding the knife 44 that produced the product 64. The flute 62 accelerates the diced product 64 to the velocity at the location on the flute 62 that captures and cradles the product 64, after which the product 64 is propelled from the size-reduction unit 30 with centrifugal force as the cross-cutter 40 continues to rotate. However, in comparing FIG. 6 to FIG. 4, it can be seen that the depths of the flutes 62 are greater than the depths of the channels 134 of the cross-cutter 116 of FIGS. 1 through 3, depicted as being approximately 45% of the radius of the cross-cutter 116. The depths of the flutes 62 are preferably at least half of the radius of the cross-cutter 42, and in the embodiments shown the depths of the flutes 62 are approximately 65% of the radius of the cross-cutter 42. The deep fluted design of the cross-cutter 42 provides a smooth arcuate transition on each flute 62, which decreases the acceleration to which the diced product 64 is subjected after it is impacted and captured by the flute 62. By comparing FIG. 6 to FIG. 4, it can be also seen that the diced product 64 is stabilized and cradled in the flute 64 at a radial location of the cross-cutter 42 that is much closer to the axis of rotation of the cross-cutter 42, at which point the velocity of the product 64 is the same as the local velocity of the cross-cutter 42, so that the velocity of the product 64 is lower than if it were cradled at a radial location in the flute 64 farther from the axis of rotation.

The combined effect of the helical and fluted features of the cross-cutter 42 is to reduce the cutting and impact loads on the original and diced products 54 and 64, resulting in less product damage as compared to the cross-cutter 116 of FIGS. 1 through 3 when operating at the same rotational speed. Consequently, the size-reduction unit 30 can be operated at higher speeds to increase product throughput, the result of which can be more product processed per hour with the same or less damage to the product. Such benefits are particularly significant when dicing soft or delicate products, as nonlimiting examples, cooked chicken, baked goods such brownies and bread, and granola bars.

During investigations leading to the present invention, it was determined that the flute angle, defined herein as the angle between a radial of the cross-cutter 42 and a plane containing the surface of the flute 62 adjacent its adjoining cutting edge 62, is pertinent to the operation of the cross-cutter 42. As more readily observed in FIG. 7, the cross-cutter 42 shown in FIGS. 4 through 6 has a flute angle ($\theta$) of about 50 degrees. Flute angles significantly greater than 50 degrees, for example, about 60 degrees or more, have been observed to detain the diced product 64 in the flute 62 instead of being expelled, such that diced products 64 tend to collect in the flutes 62. This observation is believed to be attributable to the frictional force on the surface of the flute 62 being larger than the centrifugal force imparted by the rotation of the cross-cutter 42. On the other hand, flute angles significantly less than 50 degrees, for example, about 30 degrees or less, tend to impart a greater acceleration on the diced product 64 during and after being sliced, increasing the risk of damage to the product 64.

Figure 8:
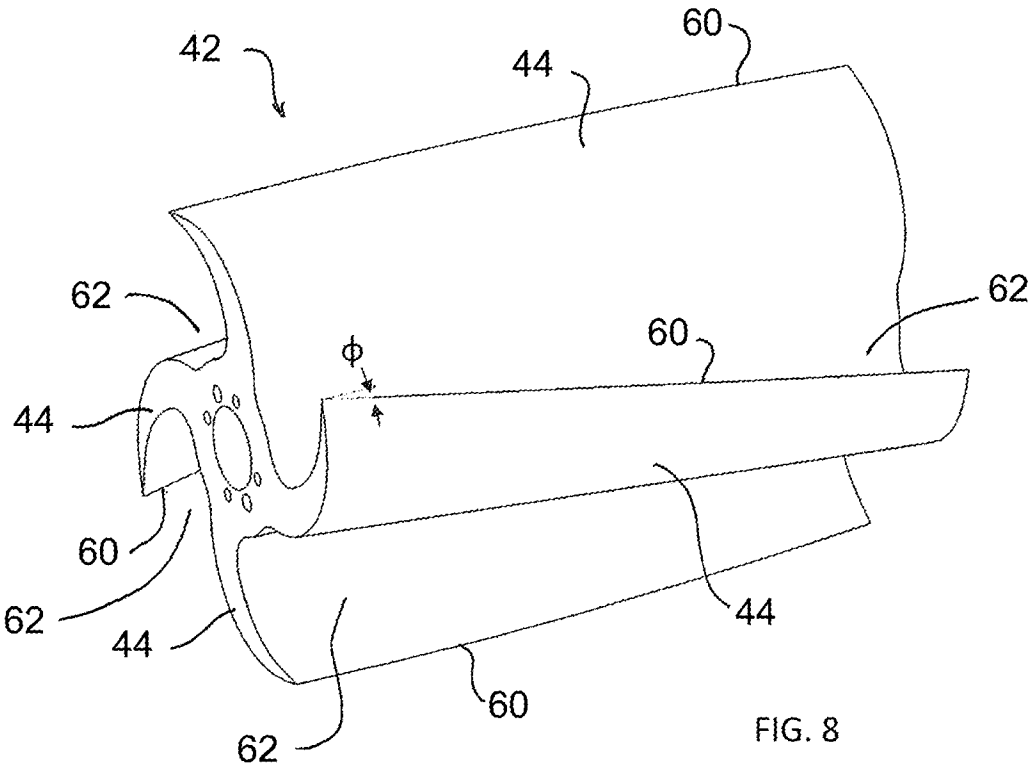
Figure 9:
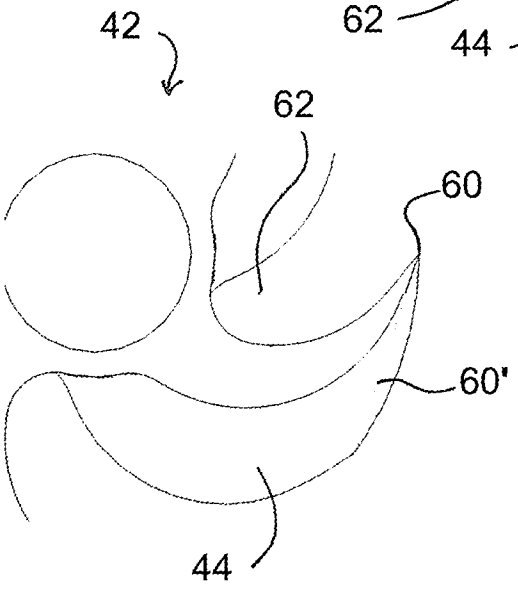

With reference to FIG. 8, the shear angle ($\phi$) of a cross-cutter knife 44 is defined herein as the angle between the cutting edge 60 of that knife 44 and a line that intersects the edge 60 and is parallel to the axis of rotation of the cross-cutter 42. The cross-cutter 42 shown in FIGS. 4 through 9 has a shear angle of about 10 degrees, though any shear angle other than zero degrees has the effect of decreasing cutting load. As previously noted, a clean and uniform cut is promoted by the entire cutting edge 60 being at a constant radius from the axis of rotation of the cross-cutter 42, such that a constant shear edge gap exits with the shear edge 58 of the stripper plate 40. As a consequence, the shear angle follows a helical curved path. As evident from FIG. 9, if the shear angle were to be straight, the resulting cutting edges 60' of the cross-cutter 42 would not maintain a constant shear edge gap and would produce a lower quality cut.

Figure 10:
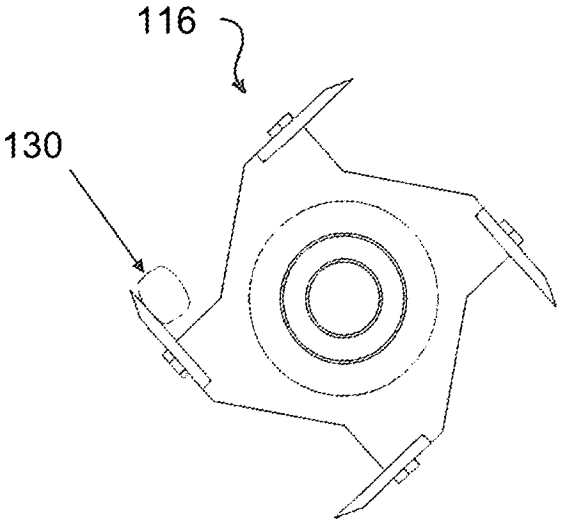
FIGS. 10 and 11 contain graphs plotting predicted impact dynamics for the prior art cross-cutter of FIGS. 1 through 3 and the cross-cutter of FIGS. 4 through 9.
Figure 10:
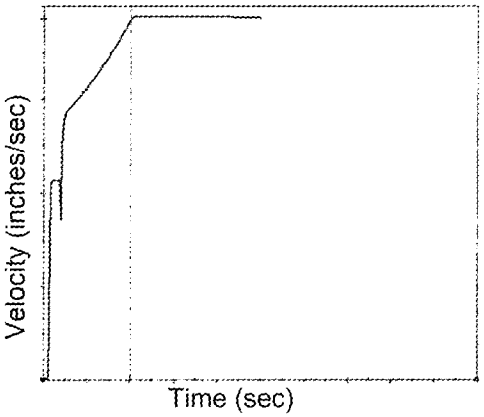
Figure 11:
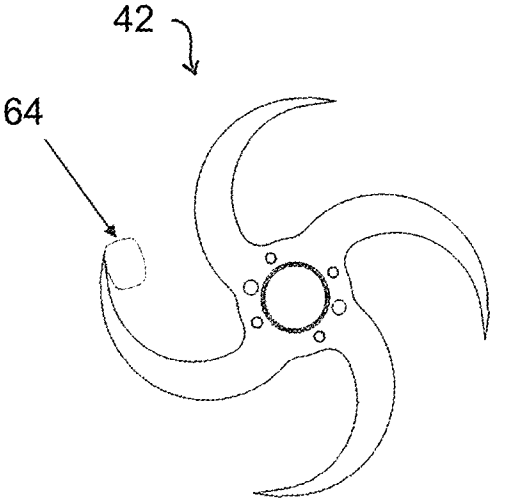
Figure 11:
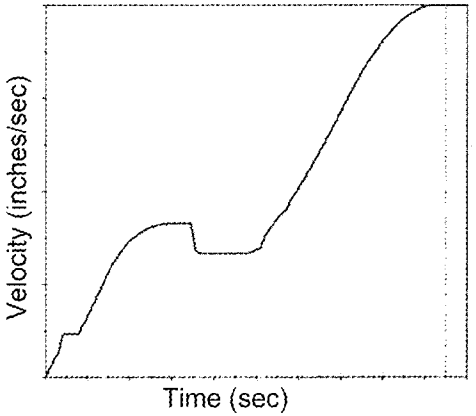

FIGS. 10 and 11 represent results of dynamic modeling performed to compare the elastic impacts and rigid body dynamics of a cross-cutter of the type represented in FIGS. 1 through 3 and a cross-cutter of the type represented in FIGS. 4 through 9. FIG. 10 indicates that the simulated cross-cutter of FIGS. 1 through 3 would impact and accelerate a diced product over a span of about 4 milliseconds, corresponding to a very harsh impact and high acceleration. In comparison, FIG. 11 indicates that the cross-cutter of FIGS. 4 through 9 more gradually accelerates a diced product over a much longer span of about 19 milliseconds, corresponding to a much lower impact on the product.

During additional investigations leading to the present invention, the performances of experimental cross-cutters within the scope of the present invention were compared with a prior art cross-cutter of the type shown in FIGS. 1 through 3. Cooked chicken breasts were fed into a Model M6™ dicer, which sliced the chicken with a circular cutter (for example, 4 in FIGS. 1 through 3, and 34 in FIGS. 4 and 6) before undergoing cross-cutting with the installed cross-cutter to produce a diced chicken product. The prior art cross-cutter had a conventional zero shear angle (as defined in reference to FIGS. 1 through 3), whereas an experimental cross-cutter had a helical fluted configuration (as defined above in reference to FIGS. 4 through 6) characterized by a 10-degree (non-zero) shear angle. For comparison, a second experimental cross-cutter was also evaluated that had a fluted configuration (as defined above in reference to FIGS. 4 through 6), but whose cutting edges did not have a helical shape. Consequently, the experimental cross-cutters differed as a result of the experimental helical fluted cross-cutter having a non-zero shear angle resulting from the helical geometric shape of its knife cutting edges, and the experimental fluted cross-cutter having a zero shear angle resulting from its knife cutting edges being parallel to its rotational axis. The diced chicken product was assessed on the basis of the yield of product too large to pass through a 7/16 inch screen. When operating with the prior art, experimental helical fluted, and experimental fluted cross-cutters, the Model M6™ dicer produced a yield of, respectively, 68%, 77%, and 74%. The significantly improved yield exhibited by the experimental fluted cross-cutter was attributed to the reduced impact loads resulting from its fluted configuration, and the greater improved yield exhibited by the experimental helical fluted cross-cutter was attributed to the combined effects of reducing cutting loads and impact loads resulting from, respectively, its combined helical and fluted configurations.

Figure 12:
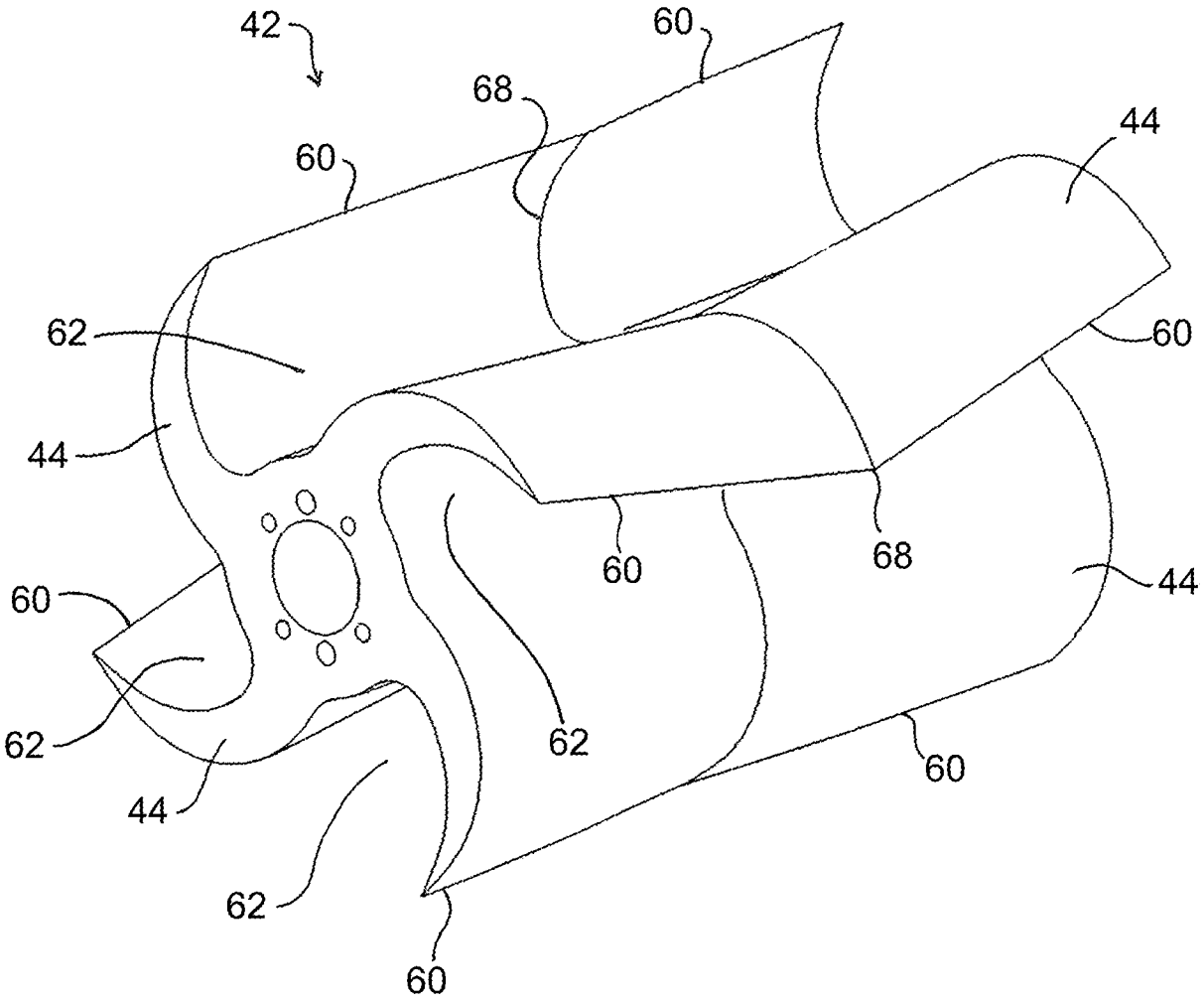
FIGS. 12 and 13 are isolated views of alternative embodiments of cross-cutters suitable for use in the size-reduction unit of FIGS. 4 through 6 and a size-reduction machine of the type represented in FIG. 1.
Figure 13:
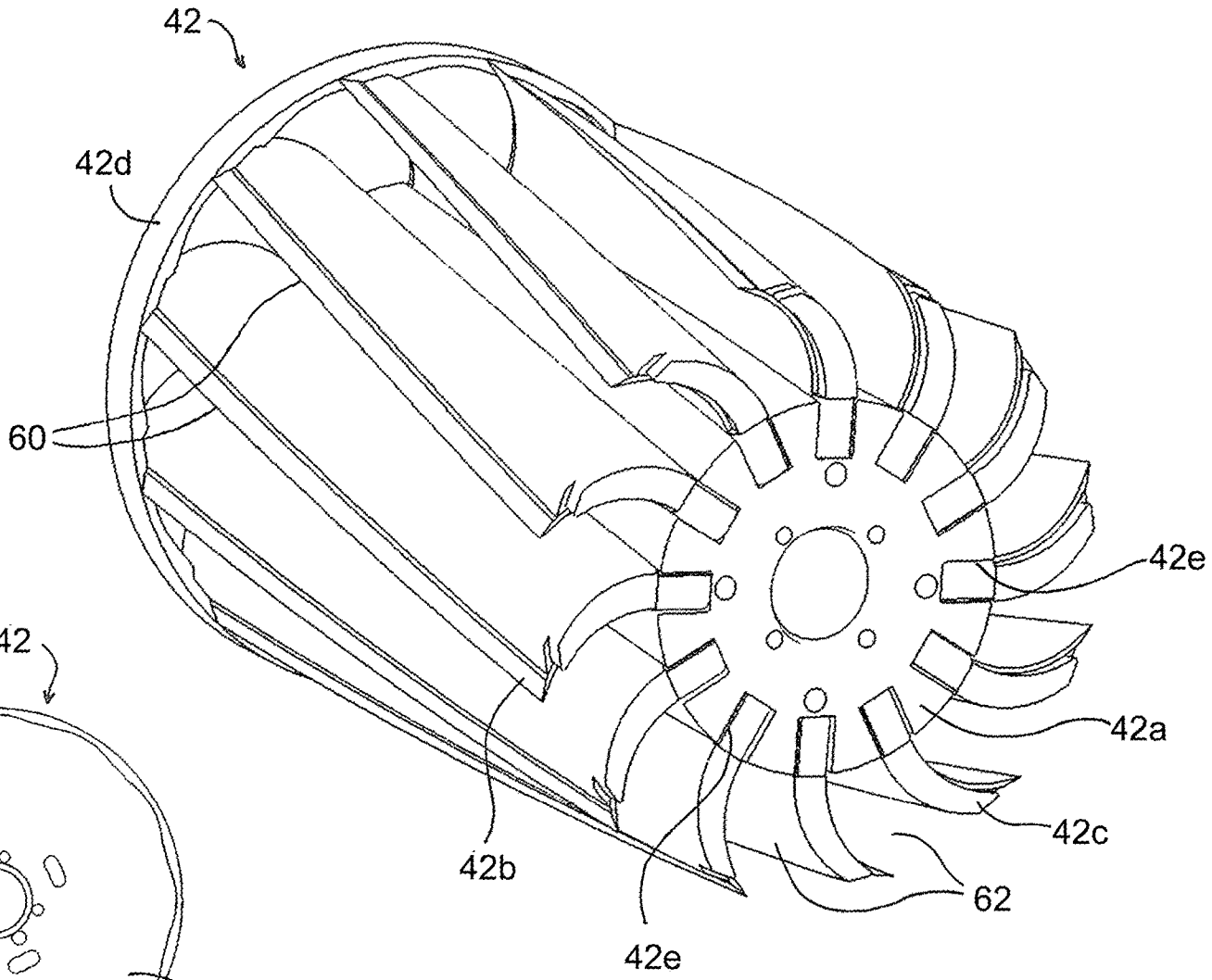
Figure 14:
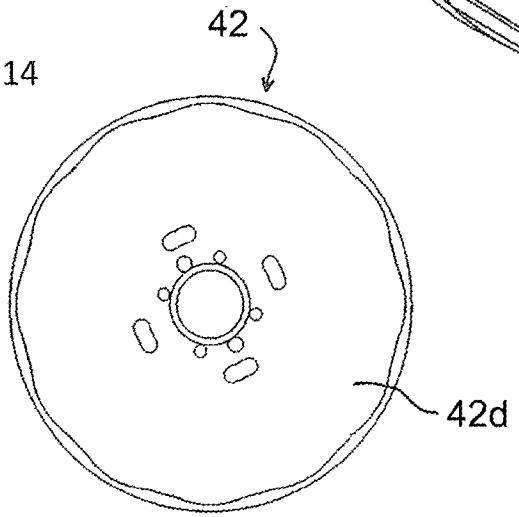
FIG. 14 is an isolated view of an end cap of the cross-cutter of FIG. 13.
Figure 15:
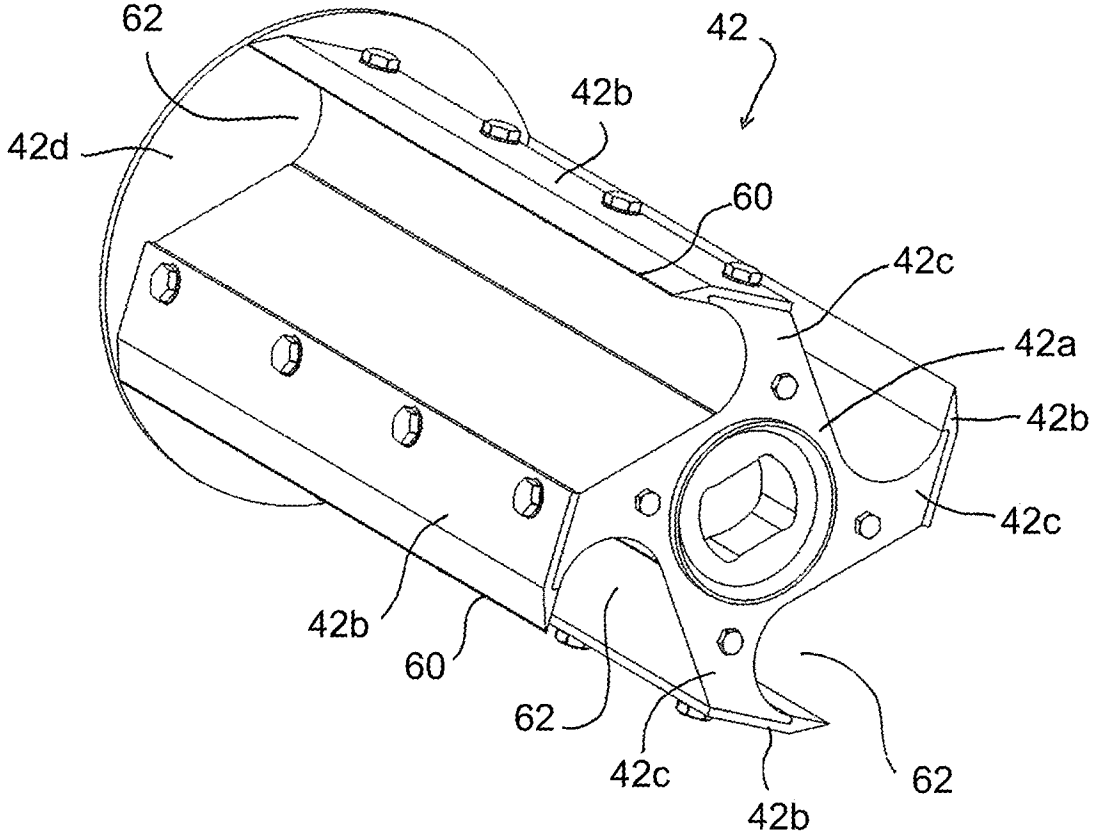
FIG. 15 is an isolated views of another alternative embodiment of a cross-cutter suitable for use in the size-reduction unit of FIGS. 4 through 6 and a size-reduction machine of the type represented in FIG. 1.

FIGS. 12, 13, and 15 are isolated views of alternative embodiments of cross-cutters suitable for use in the size-reduction unit 30 of FIGS. 4 through 6 and a size-reduction machine of the type represented in FIG. 1. FIG. 12 depicts a herringbone design in which the cutting edge 60 of each knife 44 of the cross-cutter 42 has a segment located in one of two opposite longitudinal halves of the cross-cutter 42. The segments of each cutting edge 60 has opposite but equal helix angles (and shear angles), with each half of the cutting edge 60 retaining the helical and fluted design aspects of the cross-cutter 42 of FIGS. 4 through 9. A herringbone cross-cutter 42 such as shown in FIG. 12 causes diced products 64 to travel through the flutes 62 in opposite axial directions away from an apex 68 of each cutting edge 60, which is shown but not required to be located at the longitudinal center of each knife 44. A benefit of this design is that there is no net axial load on bearings supporting the cross-cutter 42.

FIG. 13 depicts a cross-cutter 42 whose knives 44 are replaceable, but otherwise retains the helical and fluted design aspects of the cross-cutter 42 of FIGS. 4 through 9. The cross-cutter 42 of FIG. 13 comprises a rotor 42*a*, multiple knives 42*b*, a knife holder 42*c* for each knife 42*b*, and end caps 42*d* (FIG. 14) for retaining the knife holders 42*c* in slots 42*e* formed in the rotor 42*a*. A benefit of the replaceable knives 44 is the ability to replace any or all of the knives 42*b* in the event that they become worn or damaged.

FIG. 15 depicts a cross-cutter 42 that is also equipped with replaceable knives 44. Though the cross-cutter 42 retains the fluted design aspect of the cross-cutter 42 of FIGS. 4 through 9, it does not retain its helical aspect. Similar to the embodiment of FIG. 13, the cross-cutter of FIG. 15 comprises a rotor 42*a*, multiple knives 42*b* secured to the rotor 42*a* at a knife holder 42*c*, and end caps 42*d* (only one of which is shown).

Figure 16:
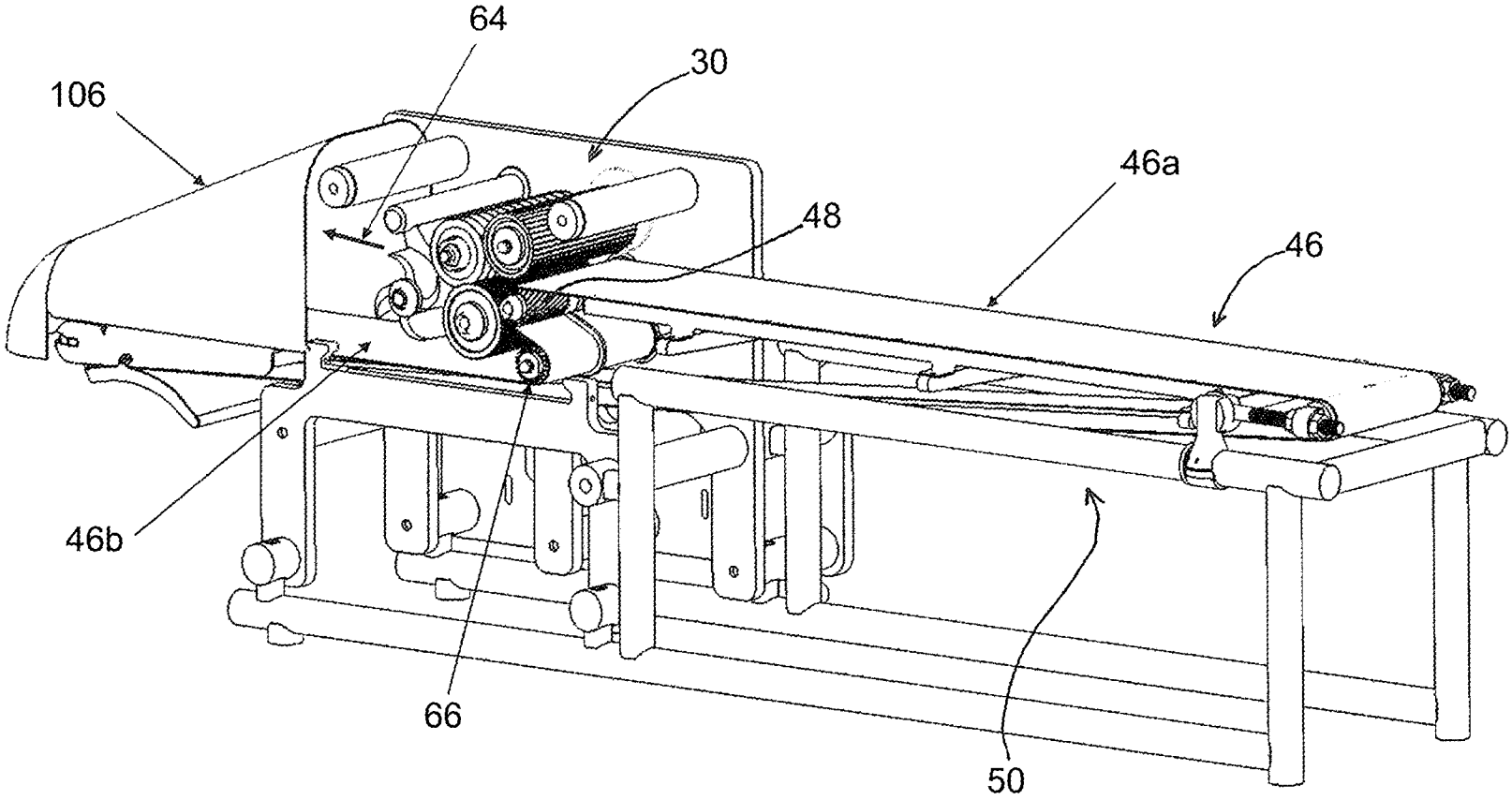
FIGS. 16 through 18 are various views of an alternative embodiment of a conveyor unit suitable for use with the size-reduction units of FIGS. 4 through 6, cross-cutters of FIGS. 7 through 9 and 12 through 15, and a size-reduction machine of the type represented in FIG. 1.
Figure 17:
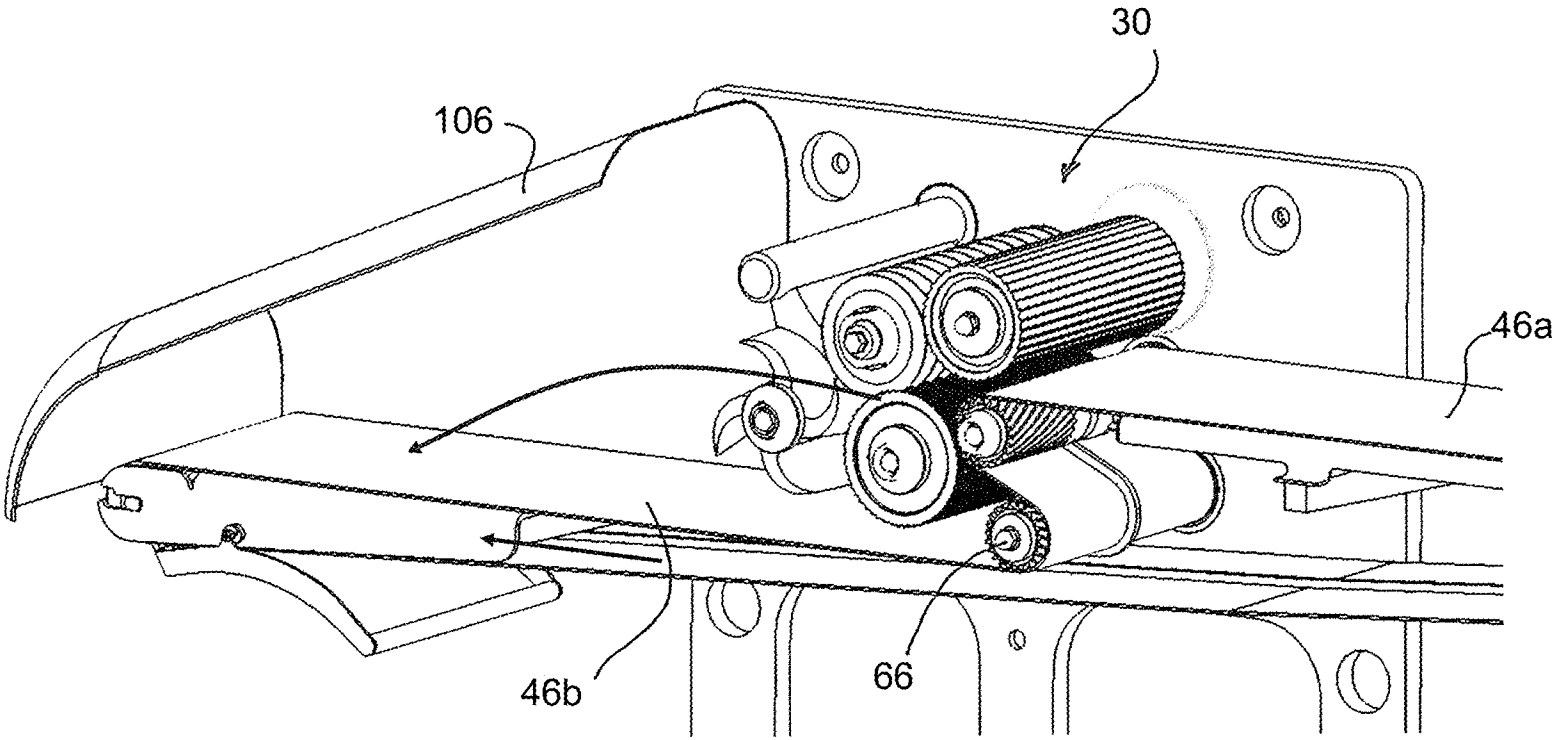
Figure 18:
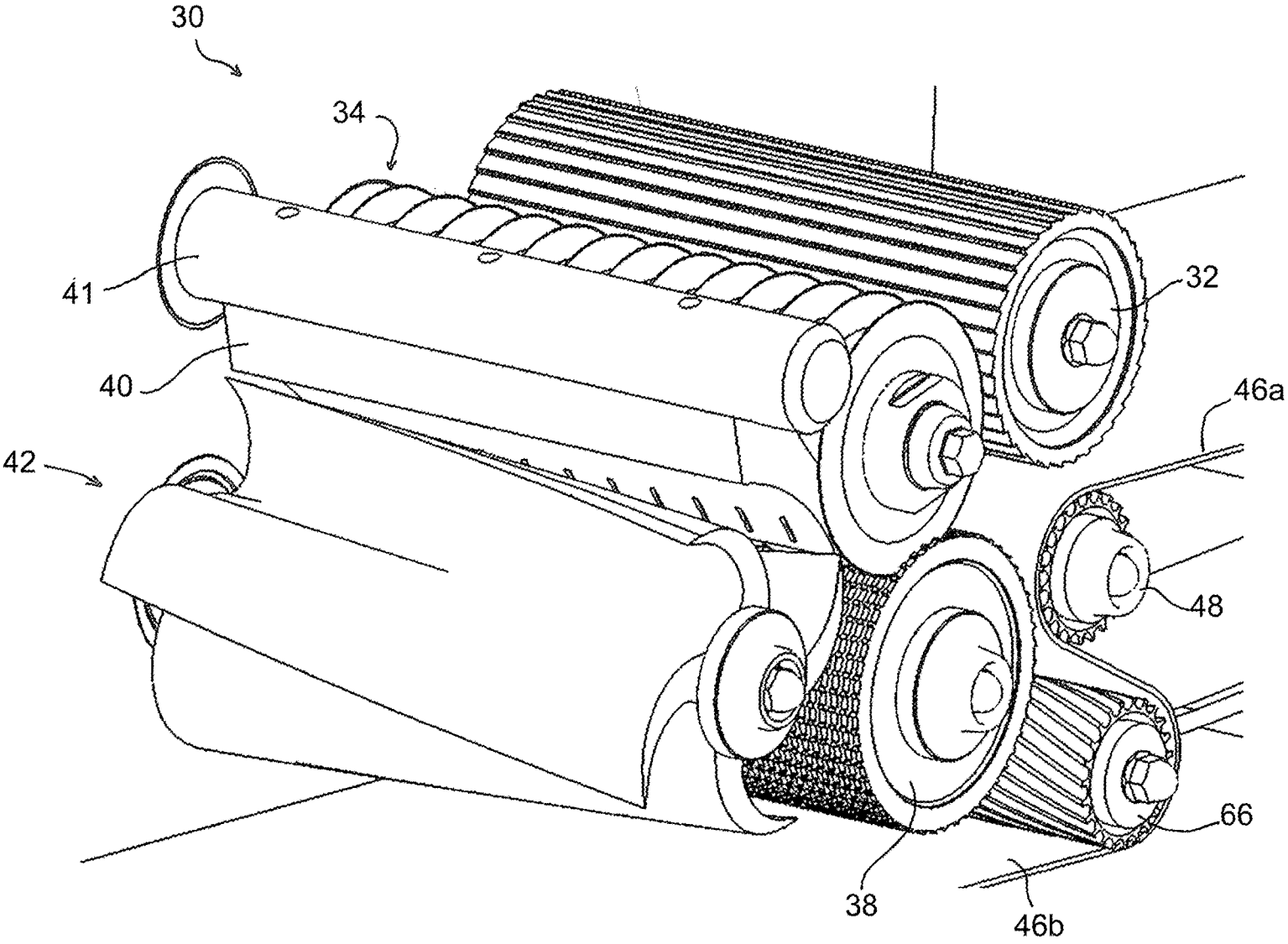

FIGS. 16 through 18 are various views of an alternative embodiment of a conveyor unit 50 suitable for use with the size-reduction units of FIGS. 4 through 6, cross-cutters of FIGS. 7 through 9 and 12 through 15, and a size-reduction machine of the type represented in FIG. 1. In the embodiment shown, the belt 46 upstream of the entrance to the size-reduction unit 30 defines an infeed belt section 46*a*, and the belt 46 extends into the discharge chute 106 to further provide an outfeed belt section 46*b* at the outlet of the size-reduction unit 30. The entire belt 46 may be driven by a single drive roller 48, instead of two separate drive rollers that would be required to operate separate infeed and discharge conveyors. The conveyor unit 50 includes a reversing roll 66 so that the infeed and outfeed belt sections 46*a* and 46*b* of the belt 46 are staggered at different heights. A benefit of this design is that diced product 64 thrown from the cross-cutter 42 travels in the same direction as the direction of travel of the outfeed belt section 46*a*. The result is a lower velocity differential between the product 64 and the surface (belt section 46*b*) first encountered by the product 64 after leaving the size-reduction unit 30, thus minimizing impact forces as compared to landing against the static discharge chute 106. Another benefit is that small fines resulting from the dicing process cannot fall between the entrance and outlet of the size-reduction unit 30 because there is no gap between the infeed and outfeed sections 46*a* and 46*b*. Yet another benefit is that sticky diced product 64 is less likely to stick to the belt 46 as compared to being thrown against the static discharge chute 106.

While the invention has been described in terms of specific or particular embodiments, it is apparent that further alternatives could be adopted by one skilled in the art. For example, the machine, size-reduction unit 30, and their components could differ in appearance and construction from the embodiments described herein and shown in the drawings, functions of certain components of the machine and size-reduction unit 30 could be performed by components of different construction but capable of a similar (though not necessarily equivalent) function, and various materials could be used in the fabrication of the machine, size-reduction unit 30, and their components. As such, it should be understood that the above detailed description is intended to describe the particular embodiments represented in the drawings and certain but not necessarily all features and aspects thereof, and to identify certain but not necessarily all alternatives to the embodiments and described features and aspects. As a nonlimiting example, the invention encompasses additional or alternative embodiments in which one or more features or aspects of a particular embodiment could be eliminated or two or more features or aspects of different disclosed embodiments could be combined. Accordingly, it should be understood that the invention is not necessarily limited to any embodiment described herein or illustrated in the drawings. It should also be understood that the phraseology and terminology employed above are for the purpose of describing the illustrated embodiment, and do not necessarily serve as limitations to the scope of the invention. Therefore, the scope of the invention is to be limited only by the following claims.

The invention claimed is:

1. A size-reduction unit comprising:

a circular cutter adapted and arranged to cut a product into strips;

a rotating cross-cutter adapted and arranged to receive the strips from the circular cutter, the cross-cutter comprising knives each having a concave surface that terminates at an adjoining cutting edge, the cutting edges being adapted and arranged to cut the strips into a size-reduced product, each of the cutting edges being at a constant radius from an axis of rotation of the cross-cutter, a stripper plate defining a shear edge in proximity to the cutting edge of each of the knives of the cross-cutter as the cutting edges encounter the shear edge during rotation of the cross-cutter;

wherein the cross-cutter has a helical fluted shape and comprising flutes between adjacent pairs of the knives, the concave surface defines a surface of the flute and the flutes are adapted and arranged to stabilize and cradle the product at a radial location close to the axis of rotation of the cross cutter, and each of the concave surfaces defines a flute angle of greater than 30 degrees to less than 60 degrees at the cutting edge thereof, and each of the flutes has a radial depth that is at least 50% of the constant radius of the cutting edges.

2. The size-reduction unit according to claim 1, wherein each of the cutting edges has a helical geometric shape.

3. The size-reduction unit according to claim 1, wherein the flutes have helical shapes and are not parallel to an axis of rotation of the cross-cutter.

4. The size-reduction unit according to claim 1, wherein each of the cutting edges has a nonparallel relationship with the shear edge of the stripper plate to define a non-zero shear angle.

5. The size-reduction unit according to claim 1, wherein the entirety of each of the cutting edges is at the constant radius from the axis of rotation of the cross-cutter so that a spacial relationship between the cutting edge and the shear edge of the stripper plate is the same along the entire length of the cutting edge as the cutting edge progressively interacts with the shear edge during rotation of the cross-cutter.

6. The size-reduction unit according to claim 1, wherein the radial depths of the flutes are at least 65% of the constant radius of the cutting edges.

7. The size-reduction unit according to claim 1, wherein the flute angles defined by the arcuate concave surfaces are each 50 degrees to less than 60 degrees.

8. The size-reduction unit according to claim 1, wherein the cross-cutter has a herringbone shape in which each cutting edge defines opposite but equal helix angles within opposite longitudinal halves of the cross-cutter.

9. The size-reduction unit according to claim 1, wherein the knives of the cross-cutter are integrally formed features of the cross-cutter.

10. The size-reduction unit according to claim 1, wherein the knives of the cross-cutter are separate components attached to a rotor of the cross-cutter.

11. A size-reduction machine comprising the size-reduction unit of claim 1.

12. The size-reduction machine according to claim 11, further comprising a conveyor unit comprising a feed belt for conveying the product to the circular cutter.

13. The size-reduction machine according to claim 12, wherein the conveyor unit comprises a belt having an infeed belt section that delivers the product to the circular cutter and an outfeed belt section that receives the size-reduced product from the cross-cutter, the outfeed belt section having a direction of travel away from the cross-cutter.

14. The size-reduction machine according to claim 13, wherein the belt is driven by a single drive roller.

15. The size-reduction machine according to claim 13, wherein the cross-cutter is adapted and configured to throw the size-reduced product in the same direction as the direction of travel of the outfeed belt section.

16. The size-reduction machine according to claim 11, wherein the machine is a dicing machine.

17. A method of using the machine of claim 11, the method comprising:

feeding the product to the circular cutter to produce the strips;

rotating the cross-cutter to dice the strips with the knives of the cross-cutter and produce diced product;

capturing the diced product in the flutes of the cross-cutter as the cross-cutter rotates; and then expelling the diced product from the flutes of the cross-cutter as the cross-cutter continues to rotate.

18. The method according to claim 17, wherein the entire cutting edge of each knife does not simultaneously engage the product but instead produces the cross-cut in the strips via a scissor action.

19. The method according to claim 17, further comprising a conveyor unit having an infeed belt section that delivers the product to the circular cutter and an outfeed belt section that receives the diced product from the cross-cutter, the outfeed belt section having a direction of travel away from the cross-cutter.

20. The method according to claim 19, wherein the cross-cutter throws the diced product in the same direction as the direction of travel of the outfeed belt section.

* * * * *